United States Patent [19]

Ingham

[11] 4,345,808

[45] Aug. 24, 1982

[54] ELECTRICAL CONNECTOR

[75] Inventor: Francis H. Ingham, Scottsdale, Ariz.

[73] Assignee: International Telephone and Telegraph Corporation, New York, N.Y.

[21] Appl. No.: 208,525

[22] Filed: Nov. 20, 1980

[51] Int. Cl.[3] ..... H01R 13/44; H01R 13/60

[52] U.S. Cl. ..... 339/40; 339/43; 339/44 R

[58] Field of Search ..... 339/40, 42, 43, 44 R, 339/44 M

[56] References Cited

U.S. PATENT DOCUMENTS 4,176,897 12/1979 Cameron ..... 339/43 X

FOREIGN PATENT DOCUMENTS 2059081 6/1971 Fed. Rep. of Germany ..... 339/43

620817 3/1949 United Kingdom ..... 339/43

*Primary Examiner*—Joseph H. McGlynn
*Assistant Examiner*—Frank H. McKenzie, Jr.
*Attorney, Agent, or Firm*—Thomas L. Peterson

[57] ABSTRACT

An electrical connector is disclosed in which the mating plug and receptacle connector members are each provided with doors normally closing their forward mating ends to provide EMI and environmental protection. To mate the connector members, an actuator on the plug connector member is operated to open the doors thereon which engage outer portions of the doors on the receptacle connector member causing the latter to open automatically during the mating sequence. The operating sequence minimizes the time that the unsealed interfaces of the connector members are exposed to the environment.

12 Claims, 8 Drawing Figures

ELECTRICAL CONNECTOR

BACKGROUND OF THE INVENTION

The present invention relates generally to an electrical connector and, more particularly, to a connector which provides electrical shielding and mechanical protection from the environment for the mating connector members of the connector.

Occasionally electrical connectors must be utilized in hostile environments where they will be subjected to dust or moisture in the environment. Further, in certain connector applications, the circuits in the connector must be protected from electromagnetic radiation. As a result, it is desirable to provide electrical shielding and mechanical protection for the mating plug and receptacle connector members of a connector assembly in both their mated and unmated conditions.

U.S. Pat. No. 4,176,897 discusses the foregoing problem and discloses a connector in which the mating connector members contain doors covering their forward mating ends which swing inwardly to open when the connector members are mated. The doors are shifted to their open position by engagement by the shell of one member and the insert of the other member. German Pat. No. 2,059,081 discloses an electrical connector in which each connector member has a single pivoted door which closes its forward mating end, and an outwardly extending actuating arm which engages a tab on the door of the mating connector member to automatically open the same when the connector members are mated.

It is an object of the present invention to provide a unique electrical connector which provides protection against electromagnetic interference and environmental contamination in which the doors on one connector member engage the doors on the other connector member to automatically open the latter when the connector members are mated.

SUMMARY OF THE INVENTION

According to a principal aspect of the present invention, there is provided an electrical connector comprising first and second mating connector members each comprising a shell having a forward mating end. Closure means is provided on each connector shell closing its forward mating end when the connector members are unmated. Means is provided for selectively shifting the first closure means to an open position. The first closure means, when in said open position, automatically opens the second closure means during mating of the first and second connector members.

Actuation of the closure means on the two connector members is simple and straightforward. Opening the closure means on the first connector member, typically the plug connector member, may be performed manually or by a mechanical operator, and opening of the closure means on the mating receptacle connector member is the result of contact by the closure means on the plug connector member and progressive motion bringing the two connector members into mating condition.

DESCRIPTION OF THE PREFERRED EMBODIMENT

Figure 1:
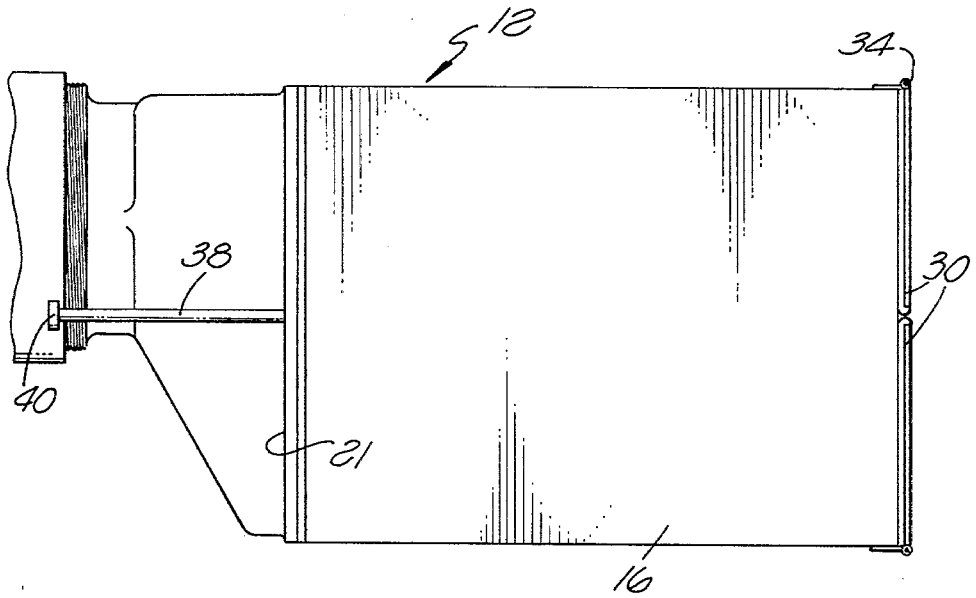
FIG. 1 is a side elevational view of the plug connector member of the present invention.
Figure 2:
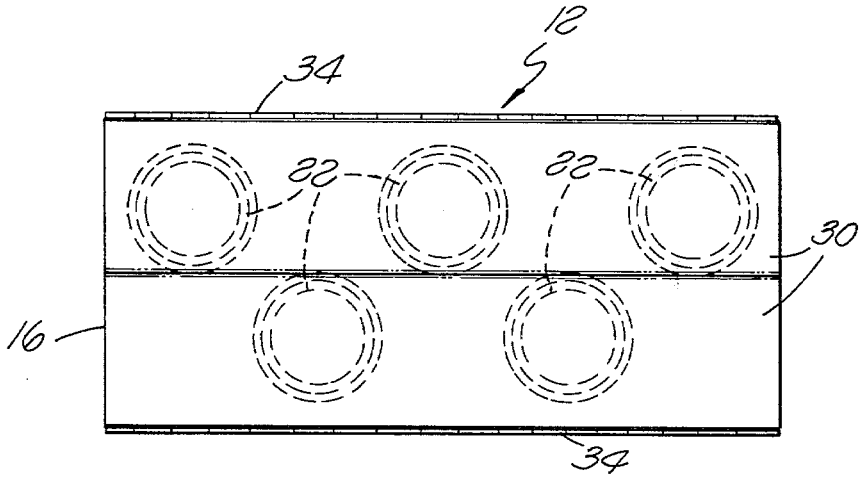
FIG. 2 is a front end view of the plug connector member illustrated in FIG. 1.

Referring now to the drawings in detail, the connector of the present invention, generally designated 10, comprises a plug connector member 12 and a mating receptacle connector member 14. The plug connector member 12 comprises a rectangular shell 16 coupled to a cable 18. An end cover 20 is mounted on the rear 22 of the shell. Two rows of plug connectors 22 are mounted in a mounting plate 24 inside the shell 16. The number of rows of connectors 22 as well as the number of connectors is a matter of choice depending upon the specific application in which the invention will be used. Each plug connector 22 contains a plurality of pin contacts 26, only one being seen in the plug connector illustrated. The pin contacts of the plug connectors 22 are connected to conductors 28 in the cable 18.

A pair of doors 30 are pivotably mounted to the upper and lower edges of the shell 16 adjacent to its forward mating end 32 by a pair of parallel hinges 34. The hinges are spring loaded normally urging the doors into a closed position as illustrated in FIG. 1. Preferably the inner face of each door is provided with an environmental and an electromagnetic seal 36, which may be formed of silver filled elastomer.

The doors 30 are opened by a pair of actuating rods 38, one for each door. Each rod 38 extends outwardly beyond the rear 22 of the shell 16, and terminates in a head 40. Each rod passes through a bore 42 of an inwardly extending flange 44 formed on the shell 16. A coil spring 46 surrounds the rod between the flange 44 and a flange 48 on the rod normally urging the rod to a rearward position as illustrated in FIG. 1 in which the head 40 on the rod is spaced behind the rear 22 of the connector shell. The forward end of each rod 38 is connected to the two doors 30 by links 50. The links have a pivoted connection to the forward end of the rod and the doors. The rods 38 may be manually pushed forwardly by the operator from the position shown in FIG. 1 to the position shown in FIGS. 3 and 4 thereby shifting the inner ends of the links 50 forwardly causing the doors to be pivoted to an open position where they are generally parallel to the upper and lower surfaces of the shell 16. If desired, the rods 38 may be actuated by a mechnical minipulator, not shown, coupled to both of the rods adjacent to the heads 40 thereon.

The receptacle connector member 14 comprises a rectangular shell 52 having a mounting plate 54 therein supporting two rods of receptacle connectors 56 arranged to mate with the plug connectors 22 when the connector members 12 and 14 are interengaged. The shell 52 is dimensioned to slide into the interior of the forward end of the shell 16 of the plug connector member 12. Each receptacle connector 56 contains a plurality of socket contacts 58, only one being shown. Each contact 58 is connected to a conductor 60 of a cable 62 to which the receptacle connector member 14 is coupled.

Figure 3:
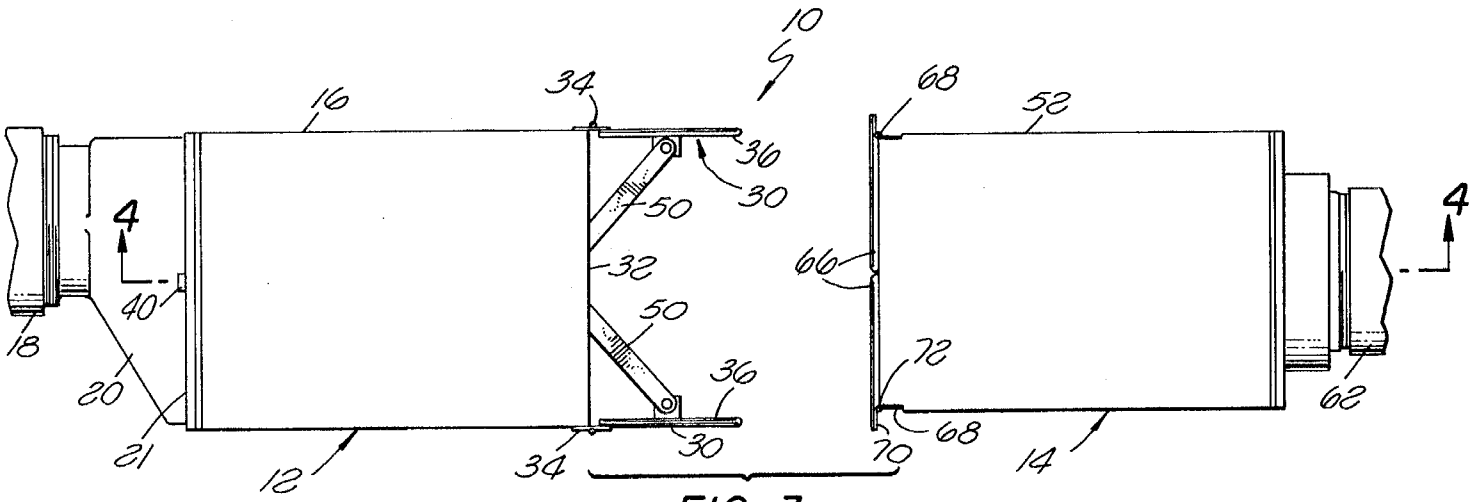
FIG. 3 is a side elevational view of the plug and receptacle connector members of the present invention in their unmated condition, with the doors on the plug connector member shown in their actuated or open position.
Figure 4:
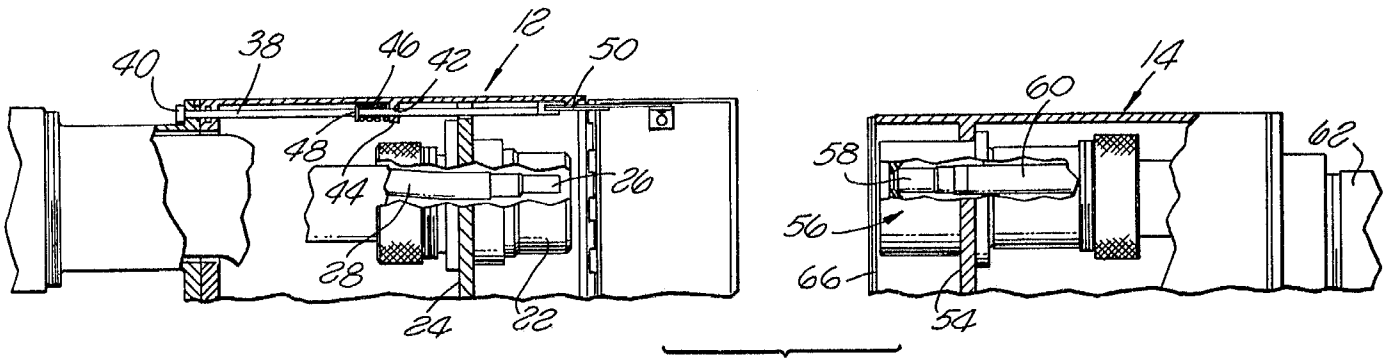
FIG. 4 is a partial longitudinal sectional view taken along line 4—4 of FIG. 3.

The forward mating end 64 of the shell 52 is normally closed by a pair of doors 66, similar to the doors 30. The doors 66 are pivotably connected to the upper and lower edges of the shell 52 by spring loaded hinges 68. Unlike the doors 30, the doors 66 embody outer actuating portions 70 which extend transversely relative to the center axis of the receptacle connector member 14 when the doors are closed, and extend outwardly from the hinge pins or pivot axes 72 of the hinges. As best seen in FIG. 3, the actuating portions 70 of the doors 66 extend outwardly a sufficient distance from their hinge pins 72 so that they will be engaged by the forward ends of the doors 30 when the connector members are mated.

Figure 5:
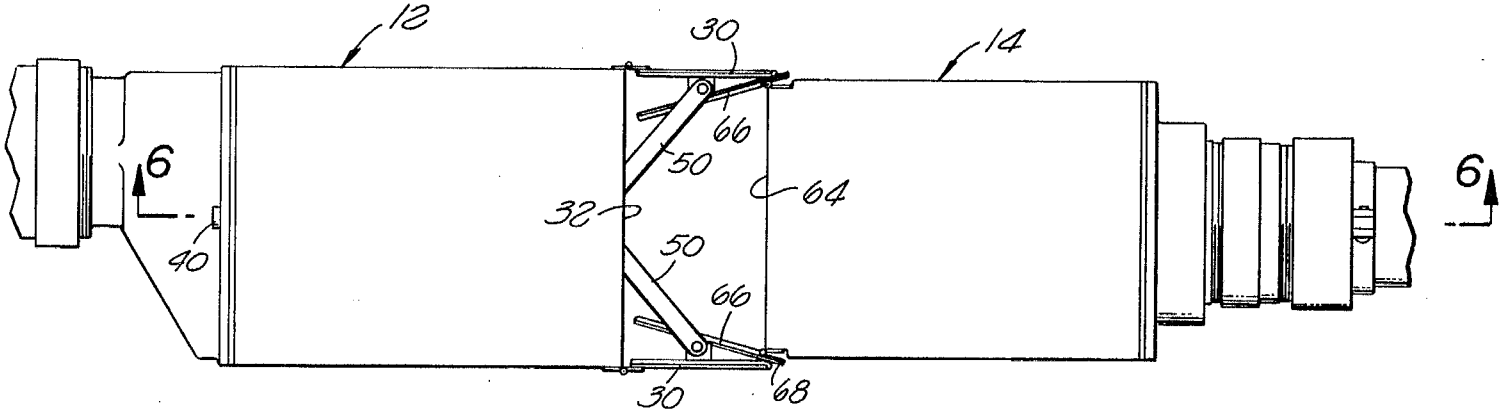
FIG. 5 is a side elevational view similar to FIG. 3 but showing the plug and receptacle connector members partially mated.
Figure 6:
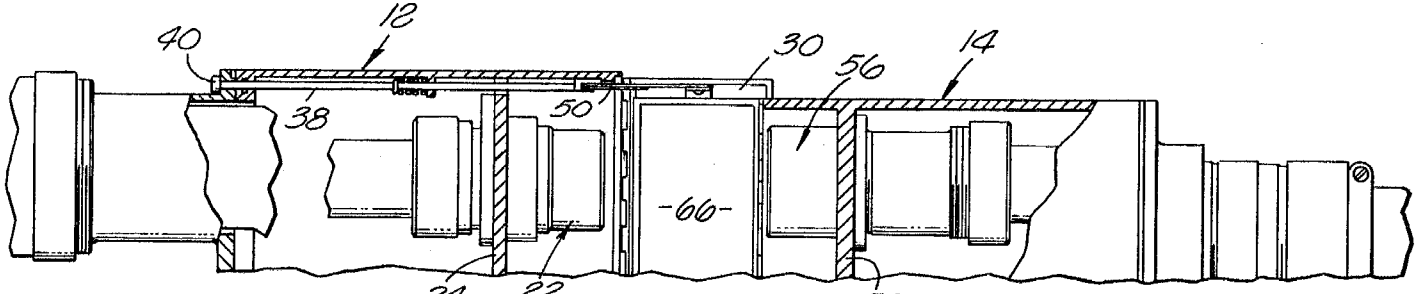
FIG. 6 is a partial longitudinal sectional view taken alone line 6—6 of FIG. 5.
Figure 7:
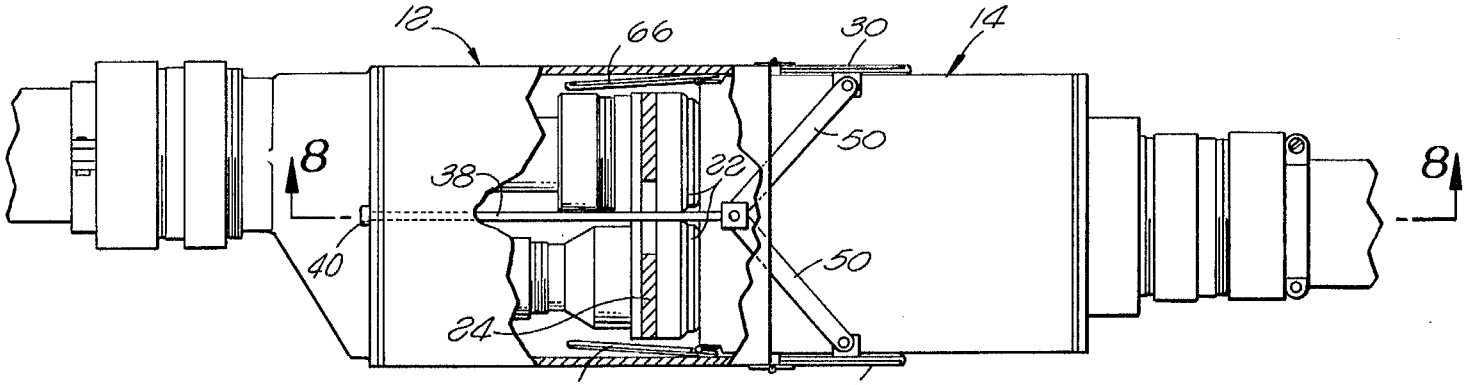
FIG. 7 is a side elevational view showing the plug and receptacle members in their fully mated condition.
Figure 8:
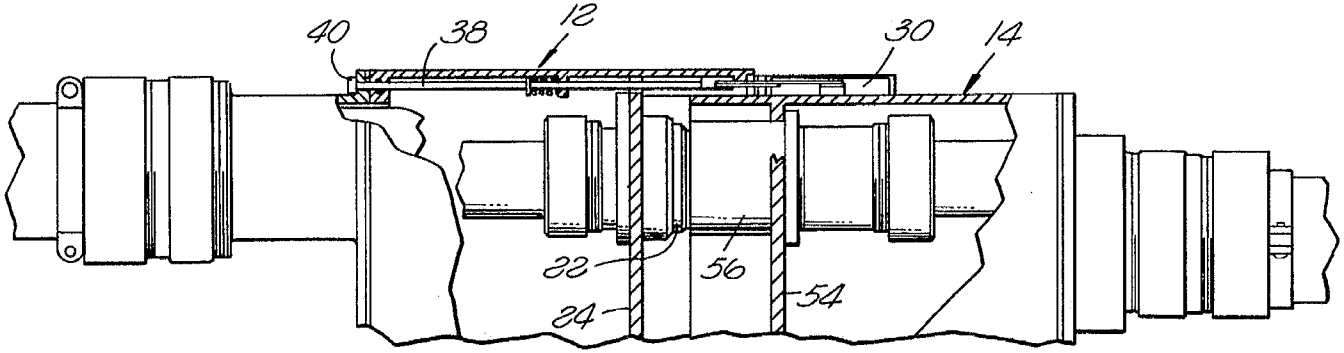
FIG. 8 is a partial longitudinal sectional view taken along line 8—8 of FIG. 7.

From the foregoing, it will be appreciated that the plug and receptacle connector members are normally closed by their respective doors when the members are unmated. To mate the connector members, the doors 30 on the plug connector member 12 are initially opened by pushing the actuating rods 38 forwardly, as seen in FIG. 3 and the receptacle connector member 14 is positioned in alignment with the plug connector member. Forward motion of the plug connector member 12 toward the receptacle connector member 14 moves the plug doors 30 into contact with the actuating portions 70 of the receptacle doors 66, causing the latter doors to swing open and nest inside the plug doors as seen in FIG. 5. Further forward movement of the connector members causes the receptacle doors 66 to become nested inside the plug shell 16 while the plug doors 30 bear against the upper and lower surfaces of the receptacle shell 52, as seen in FIG. 7. Thus, it will be seen that the receptacle doors remain closed until they are engaged by the plug doors near the end of the mating stroke of the connector members. This operating sequence minimizes the time that the forward ends of the connector members are exposed to the environment.

Unmating of the connector members 12 and 14 reverses the sequence described above. The receptacle doors 66 will close as soon as the plug doors clear them, the plug doors will automatically close as soon as they clear the receptacle connector member. The doors 66 close by the action of the spring loaded hinges 68, while the plug doors 30 close by the action of the spring loaded hinges 34 and the force of the springs 46 acting on the actuating rods 38 urging them rearwardly in the shell 16.

If desired, the connector of the present invention may include a positive locking device such as a center tang lock, not shown, of the type disclosed in U.S. Pat. No. 3,335,391 to Prow, Jr., assigned to the assignee of the present application.

From the foregoing, it will be appreciated that the connector of the present invention is relatively simple in construction, straight forward to operate and provides protection against electromagnetic radiation interference and contaminants in the environment.

What is claimed is:

1. An electrical connector comprising:

first and second mating connector members each comprising a shell having a forward mating end and a rear;

first closure means on said first connector member shell closing said forward mating end thereof when said connector members are unmated;

second closure means on said second connector member shell closing said forward mating end thereof when said connector members are unmated;

means for selectively shifting said first closure means to an open position; and said first closure means, when in said open position, automatically opening said second closure means during mating of said first and second connector members.

2. An electrical connector as set forth in claim 1 wherein:

each said closure means comprises a pivotably mounted door.

3. An electrical connector as set forth in claim 2 wherein:

each said door embodies spring means biasing the door to a normally closed position.

4. An electrical connector as set forth in claim 2 wherein:

said doors are pivotably mounted about parallel axes adjacent to corresponding sides of said forward mating ends of said shells.

5. An electrical connector as set forth in claim 4 wherein:

said door of said second closure means is nested inside said door of said first closure means during mating of said connector members.

6. An electrical connector as set forth in claim 4 wherein:

said door of said second closure means embodies an actuating portion extending tranversely relative to the center axis of the connector members when said second closure means is closed and outwardly from its pivot axis; and said actuating portion is engaged by said door of said first closure means during mating of said first and second connector members causing said door of said second closure means to pivot open.

7. An electrical connector as set forth in claim 1 wherein:

each said closure means comprises a pair of doors pivotably mounted about parallel axes adjacent to opposite sides of the forward mating end of its respective shell.

8. An electrical connector as set forth in claim 7 wherein:

said doors of said second closure means are nested inside said doors of said first closure means during mating of said connector members.

9. An electrical connector as set forth in claim 7 wherein:

said doors of said second closure means are nested inside said first connector member shell and said doors of said first closure means bear against the outer surface of said second connector member shell when said connector members are fully mated.

10. An electrical connector as set forth in claim 7 wherein:

said doors of said second closure means embody actuating portions extending transversely relative to the center axes of the connector members when said second closure means is closed and outwardly from their respective pivot axes; and said actuating portions are engaged by said doors of said first closure means during mating of said first and second connector members causing said doors of said second closure means to pivot open.

11. An electrical connector as set forth in claim 1 wherein:

said selective shifting means includes an axially movable actuating rod on said first connector member connected to said first closure means.

12. An electrical connector as set forth in claim 11 wherein:

linkage means connects the forward end of said rod to said first closure means; and the rear of said rod extends rearwardly from said rear of said first connector member shell.

* * * * *